United States Patent [19]

Jezbera

[11] Patent Number: 4,699,051

[45] Date of Patent: Oct. 13, 1987

[54] COOLING ASSEMBLY FOR HAMMER BANK

[75] Inventor: Val K. Jezbera, Thousand Oaks, Calif.

[73] Assignee: Dataproducts Corporation, Woodland Hills, Calif.

[21] Appl. No.: 941,512

[22] Filed: Dec. 12, 1986

Related U.S. Application Data

[63] Continuation of Ser. No. 329,230, Dec. 10, 1981, abandoned.

[51] Int. Cl.[4] ..... B41J 7/70

[52] U.S. Cl. ..... 101/93.34; 101/93.48; 361/384; 361/379

[58] Field of Search ..... 101/93.04, 93.09, 93.29, 101/93.30, 93.31, 93.32, 93.33, 93.34, 93.48, 111; 400/690, 690.2; 361/380, 416, 379

[56] References Cited

U.S. PATENT DOCUMENTS

| | | | |
|---|---|---|---|
| 3,308,919 | 3/1967 | Cunningham | 400/690.4 X |
| 3,643,595 | 2/1972 | Helms et al. | 101/93.34 |
| 3,671,893 | 6/1972 | Edgar et al. | 101/93.48 X |
| 3,983,806 | 10/1976 | Ish | 101/93.34 X |
| 4,037,532 | 7/1977 | Plaza et al. | 101/93.48 |
| 4,044,668 | 8/1977 | Barrus et al. | 101/93.04 |
| 4,277,816 | 7/1981 | Dunn et al. . | |
| 4,438,692 | 3/1984 | Yanadori et al. . | |

FOREIGN PATENT DOCUMENTS

| | | |
|---|---|---|
| 0019780 | 12/1980 | European Pat. Off. . |
| 20169 | 12/1980 | European Pat. Off. . |
| 01559751 | 2/1985 | European Pat. Off. . |
| 1128939 | 10/1968 | United Kingdom . |
| 1282065 | 7/1972 | United Kingdom . |
| 1491589 | 11/1977 | United Kingdom . |

*Primary Examiner*—Edward M. Coven

*Attorney, Agent, or Firm*—Spensley Horn Jubas & Lubitz

[57] ABSTRACT

A cooling apparatus for a hammer bank assembly of an impact printer. The cooling apparatus directs air onto each hammer and magnet of the hammer bank assembly and maintains the temperature differential of the hammers and magnets within predetermined ranges.

12 Claims, 5 Drawing Figures

COOLING ASSEMBLY FOR HAMMER BANK

This is a continuation of application Ser. No. 06/329,230 filed on Dec. 10, 1981, abandoned.

BACKGROUND OF THE INVENTION

1. Field of the Invention

The present invention relates to impact printers, and more particularly, to apparatus for affecting the flight time of a print hammer in a hammer bank assembly.

2. Description of the Prior Art

In high speed, moving-type impact printers of the kind typically employed in data processing systems, a separate print hammer is usually situated at each print position. There are typically 132 print positions (and hammers) across a print line. Hammer bank assemblies for this purpose are described in U.S. Pat. No. 3,643,595 to Helms et al. and U.S. Pat. No. 3,983,806 to Ishi, and in pending U.S. patent application Ser. No. 065,766, filed Aug. 20, 1979, all assigned to Dataproducts Corporation, the assignee of the present invention.

Each print hammer of such hammer bank assemblies typically has a flat, electrically conductive coil disposed in a generally rigid housing or body. The body has an impact tip at one end and is supported by a pair of crossed spring wires at the other end. Each coil is an electromagnet which is energized by passing a current through the coil. The springs provide electrical contact to the coil, and aid in restoring the hammer to its rest position subsequent to impact.

In a hammer bank assembly, each hammer is situated between a pair of stationary flat permanent magnets. When a current flows through the coil of a print hammer, the resultant magnetic field in the coil interacts with the field of the adjacent magnets, resulting in a force which propels the hammer towards the type characters and the medium being printed. The type characters are usually carried in relief on a closed loop band (FIG. 2) which rapidly passes in front of the hammer bank assembly. A particular print hammer is energized when the desired character to be printed passes in front of the print position for that print hammer. The basic configuration and operation of such a printing hammer apparatus is set forth in U.S. Pat. No. 3,279,362 to Helms, also assigned to Dataproducts Corporation. Other hammers are shown in U.S. Pat. Nos. 3,279,364 to Helms, 3,643,595 to Helms, et al., and 3,983,806 to Ishi.

To insure proper registration between the print hammer and the characters to be typed on the character band, it is important to be able to control the flight time of the print hammers (i.e., the time it takes for a hammer to move from the rest position to the impact position after energization). The flight time of a particular print hammer is a function of the magnetic flux produced by the adjacent stationary permanent magnets and the flux produced by the coil embedded in the print hammer itself.

The magnetic flux produced by the stationary permanent magnets can vary as a function of the temperature of the magnets. Specifically, the magnets can become heated by repeated energization and by the operation of adjacent print hammers. As a particular magnet grows hotter, its magnetic flux can decrease. As a result, the flight time of the print hammers adjacent that magnet will be altered as the magnet grows hotter. Furthermore, the permanent magnets of the hammer bank assembly may not all be heated at the same rate, with the result being that some magnets may become hotter than others. Thus, the variation of the individual flight time for each print hammer may be different than for other hammers. This non-uniform variation can result from some print hammers being utilized more often than others. For example, in check printing operations, only print hammers to one side are utilized (since the check does not extend across the entire length of the hammer bank assembly). Accordingly, the flight times of the print hammers on the side of the hammer bank used to print the checks would tend to change relative to the unused print hammers. This variation in the flight time of the print hammers can result in misregistration between the hammer and moving characters, thus causing the characters being printed to be poorly formed and thereby reducing the quality of the printing operation.

In order to avoid the temperature induced variation of the print hammer flight times, prior art impact printers have utilized permanent magnets, such as rare or earth alnico magnets, which have relatively little variation of magnetic flux with changes in temperature. However, these low flux variation magnets tend to be quite expensive and their use results in a significant increase in the cost of the hammer bank assembly.

Furthermore, it has been found that the magnetic flux provided by each of the coils embedded in the print hammers also varies with temperature. As a coil is repeatedly energized, the temperature of the coil and hence the resistance of the coil will rise. With a constant applied voltage and increasing resistance, the current through the coil will decrease and the flux produced by the coil will also decrease. This will also slow down the flight time of the print hammers.

In order to maintain the flux produced by the coils relatively constant, constant current sources are typically utilized to energize the coils. These constant current sources often require expensive custom integrated circuits to supply a constant current to the coils.

SUMMARY OF THE INVENTION

Accordingly, it is an object of the present invention to provide a cooling apparatus for a hammer bank assembly which will decrease the temperature induced print hammer flight time variation.

It is another object of the present invention to provide a cooling apparatus for a hammer bank assembly to reduce the temperature differential among the permanent magnets and the print hammer coils of a hammer bank assembly.

These and other objects and advantages are achieved in a hammer bank assembly which utilizes a frame member for supporting a plurality of hammers and magnets aligned in one or more rows. The hammers and magnets in each row of the hammer bank assembly are interleaved such that each pair of adjacent magnets defines a gap. A print hammer is disposed within each gap. In order to minimize the temperature differential among the permanent magnets as well as the temperature differential among the print hammer coils, a cooling assembly having a fan for producing a flow of air and a duct structure for directing the flow of air from the fan into each gap between the stationary magnets is provided. The air flowing into each gap passes over the magnets and the print hammer within the gap, dissipating heat generated by the actuation of the hammer. The cooling assembly thus maintains the temperature differential of the hammers and the temperature differential of the magnets of the hammer bank assembly within predetermined ranges.

Because temperature changes are kept to a minimum, the temperature/flux properties of the magnets in the hammer bank assembly are not critical. Therefore, low cost magnets (such as ceramic) can be employed, resulting in a significant cost savings. Although such magnets exhibit relatively sharp changes in flux as their temperature changes, the cooling assembly keeps temperature changes within a range where the flux variations will be acceptable. The increase in cost of the assembly due to the inclusion of the cooling assembly is more than offset by the reduction in cost achieved by using inexpensive magnets.

DETAILED DESCRIPTION OF THE DRAWINGS

Figure 1:
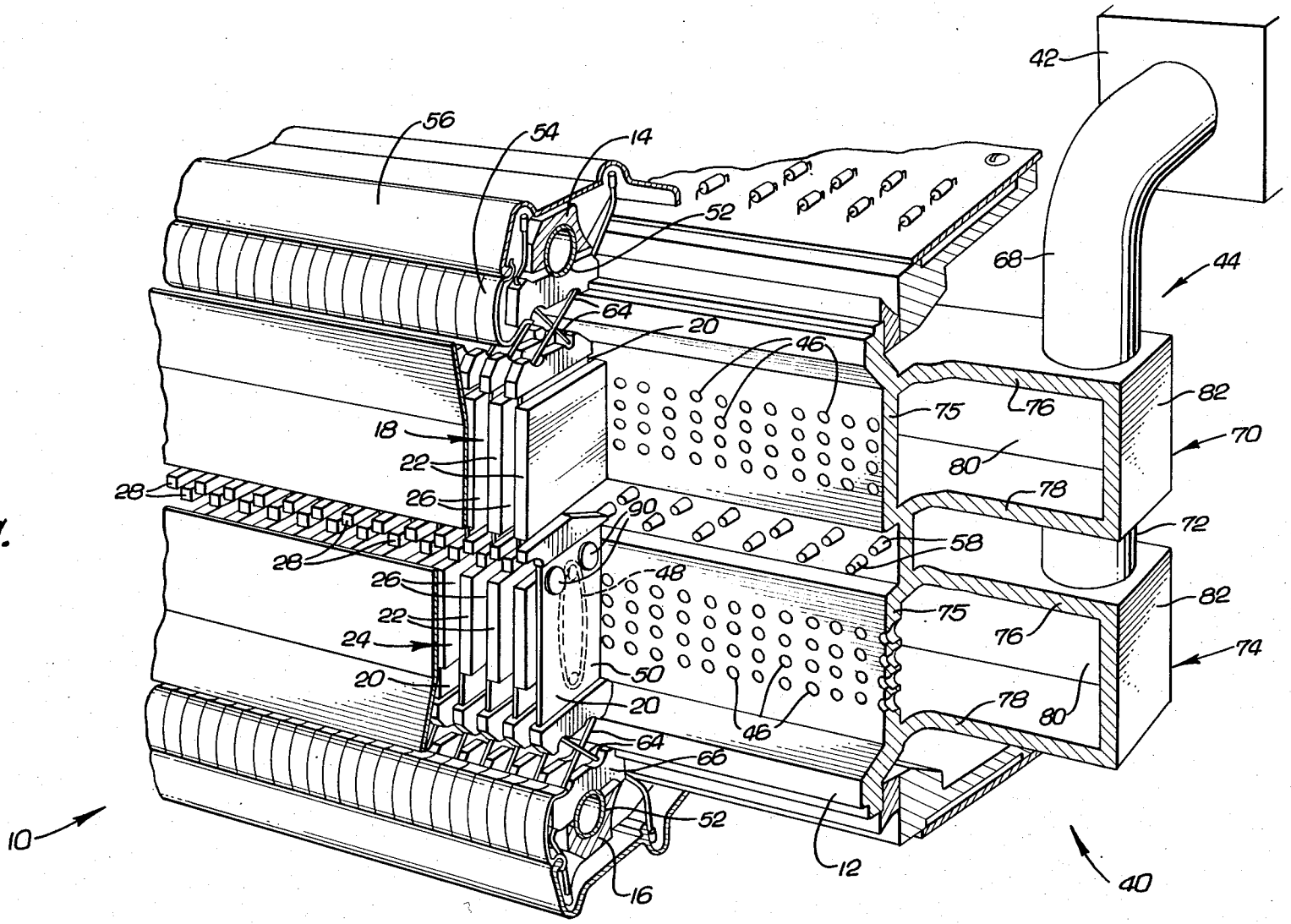
FIG. 1 is a partially broken away perspective view of a cooling apparatus for a hammer bank assembly in accordance with the present invention.

A hammer bank assembly 10 is shown in FIG. 1 to include a rear frame 12, which in the present embodiment is extruded aluminum. Secured to the rear frame 12 are upper and lower mounting brackets, or shoes, 14 and 16. The hammer bank assembly 10 has an upper row 18 of print hammers 20 and stationary permanent magnets 22 and a lower row 24 of the print hammers 20 and magnets 22. The magnets 22 are uniformly spaced from each other and mounted directly onto the rear frame 12. A gap 26 is defined between each pair of adjacent magnets 22. The print hammers 20 are interleaved among the magnets 22 such that a hammer 20 is placed within the gap 26 between each pair of adjacent magnets 22. The upper row 18 of print hammers 20 is carried by the upper shoe 14 and the lower row 24 of print hammers 20 is carried by the lower shoe 16.

Each print hammer 20 has an impact tip 28 for striking a moving character band or character drum. The impact tips 28 of the upper and lower rows 18 and 24 are aligned so that the point of impact for each of the impact tips 28 of the print hammers 20 is colinear with the impact point of the other impact tips 28 to form a single printing line.

Figure 2:
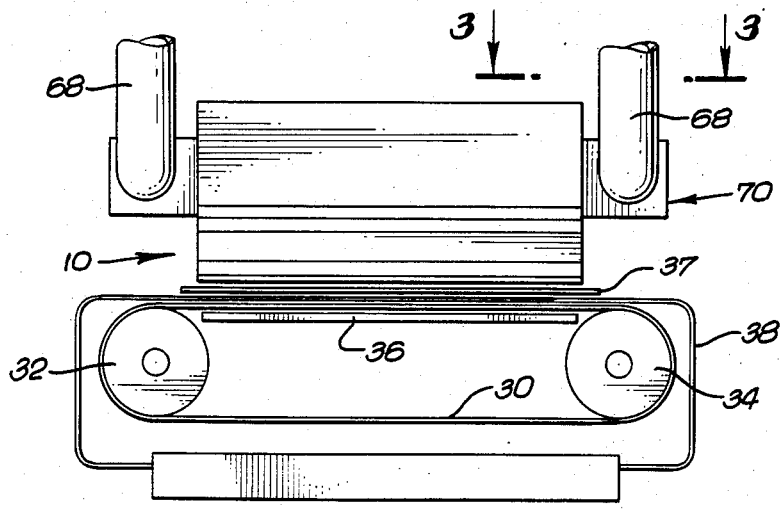
FIG. 2 is a schematic top view of an impact printer utilizing the cooling apparatus of FIG. 1.

An impact printer is schematically shown in FIG. 2 to include the hammer bank assembly 10 and a closed loop character band 30 rotatably carried on two pulleys 32 and 34. The printing characters are embossed on the band 30, which is typically made of metal such as stainless steel. The character band 30 passes over a platen 36 against which the print hammers of the hammer bank assembly 10 strike the character band 30. The paper to be printed is interposed between the impact tips 28 (not shown) of the hammer bank assembly 10 and the character band 30 as indicated at 37. The character band 30 rapidly traverses each of the impact tips 28 so that each character on the band 30 is brought to each print position across the width of the paper. When the character desired to be printed at a particular print position arrives at that print position, the print hammer 20 associated with that print position is actuated, driving the impact tip 28 forward and striking the paper against the character band 30 and platen 36. The character on the character band 30 is thus transferred onto the paper 37 at the correct print position of the line being printed. The paper 37 may be pressure sensitive to form the characters when struck by an impact tip, or a ribbon 38 may be interposed between the character band 30 and the paper 37 to transfer the characters.

Because of the rapid speed of the character band 30, it is apparent that the flight time of the impact tips 28 (the time between energization and impact) must be carefully controlled. It must be insured that the impact tip 28 arrives at the impact position at the same time that the desired character on the character band 30 arrives at that print position so that the correct character is printed on the paper. Furthermore, for high quality, clear, crisp printing, a high degree of registration between an impact tip 28 and the character of the character band 30 is required. If the impact tip arrives too early or too late, the tip may strike the character off-center, possibly causing an incomplete or displaced character to be formed on the paper.

As previously mentioned, repeated actuation of the hammers 20 can cause the print hammers 20 and stationary magnets 22 to heat up. Since the magnetic flux produced by the hammers 20 and magnets 22 can be affected by the temperature of the devices, the flight times and hence the quality of the printing can also be affected. In order to limit the maximum temperature rise and maintain the temperature differential of the magnets 22 and the print hammers 20 within certain ranges, a cooling apparatus 40 (FIG. 1) for the hammer bank assembly 10 is provided. The cooling apparatus 40 includes a fan 42 to produce a strong flow of air. The apparatus 40 further has a duct structure 44 connected to the fan 42 for directing the flow of air from the fan 42 into each of the gaps 26 between each pair of adjacent magnets 22. The duct structure 44 includes a plurality of air outlets 46 associated with each gap 26 for directing the flow of air into each gap. This flow of air cools the magnets 22 on either side of each gap 26 and also cools the hammer 20 within each gap.

By limiting the temperature rise of the magnets 22, inexpensive ceramic magnets may be used instead of rare earth alnico magnets often used previously. Such rare earth magnets typically cost as much as fifteen times as much as ceramic magnets. In addition, maintaining the temperature differential of the hammers 20 within a certain range can improve print quality, since the flux produced by the hammer coils and hence the flight time of the individual print hammers will be more uniform. Furthermore, expensive constant current sources can be eliminated, since the constant resistance of the coils (due to minimal temperature variation) enables simple voltage switches to be used.

Figure 4:
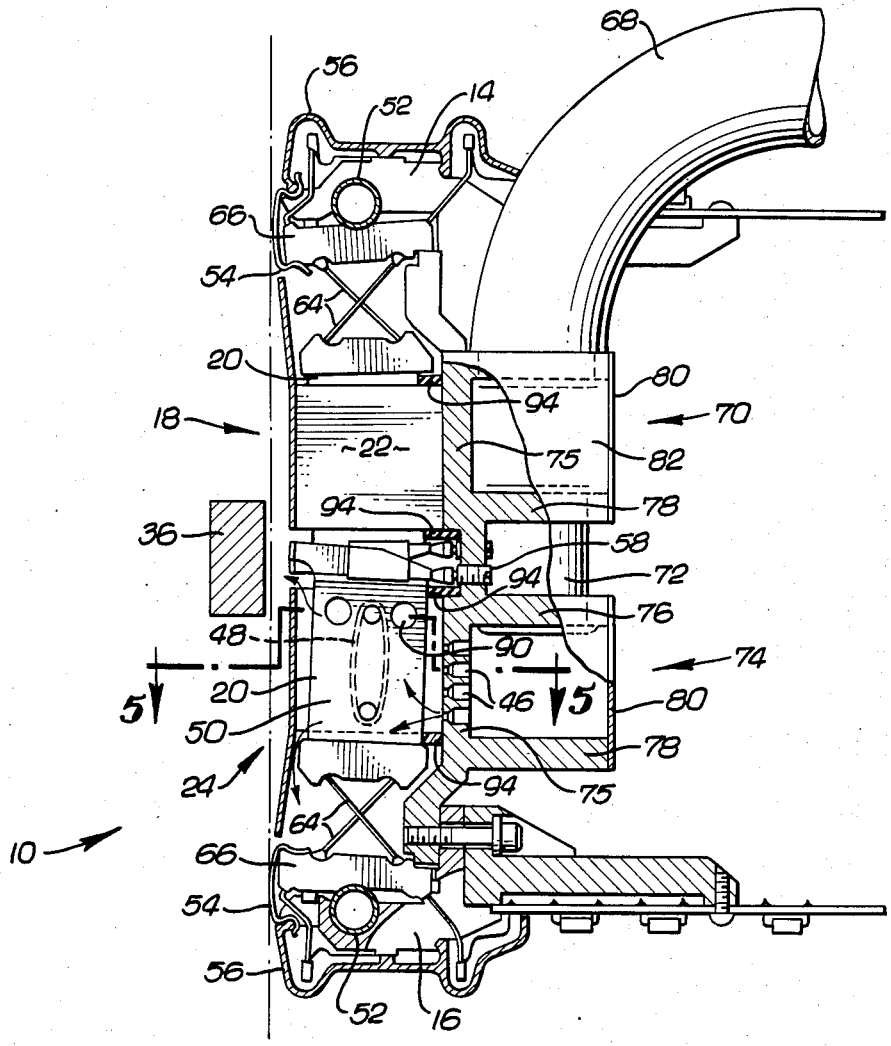
FIG. 4 is a side view along the line 4—4 of the cooling apparatus of FIG. 3 with a portion broken away.

As shown in FIGS. 1 and 4, the stationary magnets 22 are generally rectangular in shape and are secured directly to the rear frame 12 by means of an adhesive such as epoxy or an acrylic tape. The magnets 22 are permanent magnets and produce a magnetic field for use in propelling the hammers 20 toward the paper 37, the ribbon 38, the character band 30 and the platen 36 (FIG.

2). Each hammer 20 has a coil 48 of electrically conductive wire wound within a generally plate-shaped body portion 50 of the hammer 20. Each hammer 20 is actuated by passing a current through the coil 48. The coil 48 when energized by the current produces a magnetic field opposing the permanent magnetic field produced by the permanent magnet 22. The opposing magnetic fields propel the hammer 20 forward driving the impact tip 28 to the impact position.

As noted before, the actuation of the hammers 20 causes the temperature of the hammer coils 48 to rise. As the temperature of the coils 48 rise, the resistances of the coils also rise. With a constant applied voltage, the current through the heated coils will decrease, thereby reducing the flux of the magnetic fields produced by the coils 48 and slowing the flight time of the hammers. Thus, it is seen tht the flight time of a particular hammer is affected not only by the temperature of the adjacent magnets, but by the temperature of the hammer coil itself. As will become more clear in the following detailed description, the cooling apparatus 40 also maintains the temperature differential of the print hammers 20 within a certain range thereby maintaining a relatively uniform hammer flight time.

In a typical hammer bank assembly 10, there are a total of 132 print hammers and 134 stationary magnets. These numbers are illustrative only, and the principles of the present invention could be applied to hammer bank assemblies with any number of hammers and magnets. Typically, the hammers 20 have a body thickness on the order of 0.05 inches and the magnets 22 have a thickness on the order of 0.15 inches. The gap 26 between each pair of adjacent magnets 22 generally has a width of approximately 0.1 inch.

Referring further to FIG. 1, the print hammers 22 are supported on cylindrical metal tubes, or shoe stiffeners 52, which fit into and extend the length of the upper shoe 14 and the lower shoe 16. Each hammer 22 is retained on either the upper shoe 14 or the lower shoe 16 by means of a removable metal clip 54. A plastic cover portion 56 covers the shoes 14 and 16 and protects hammer connectors which extend from them. A plurality of backstop screws 58 (see also FIG. 3) are threaded into threaded holes in the rear frame 12 and are adjustable to permit individual variation of the rest position of each of the print hammers 20.

As previously mentioned, each hammer 20 includes a coil 48 in a body portion 50. Extending from the body portion 50 are a pair of conductive springs 64 (FIGS. 1 and 4) whose ends remote from the body portion 50 pass through a foot section 66. The hammer coil 48 is energized through the conductive springs 64. The print hammer foot sections 66 are secured in the upper shoe 14 (and the lower shoe 16) such that the print hammers 20 are arranged in an equally spaced parallel relationship within the gaps 26. The upper row 18 of hammers 20 connected to the upper shoe 14 are interleaved with those connected to the lower shoe 16 and the positioning is such that all of the hammers 20 in the assembly 10 (i.e., both upper and lower rows 18 and 24) will print on a common print line.

Figure 3:
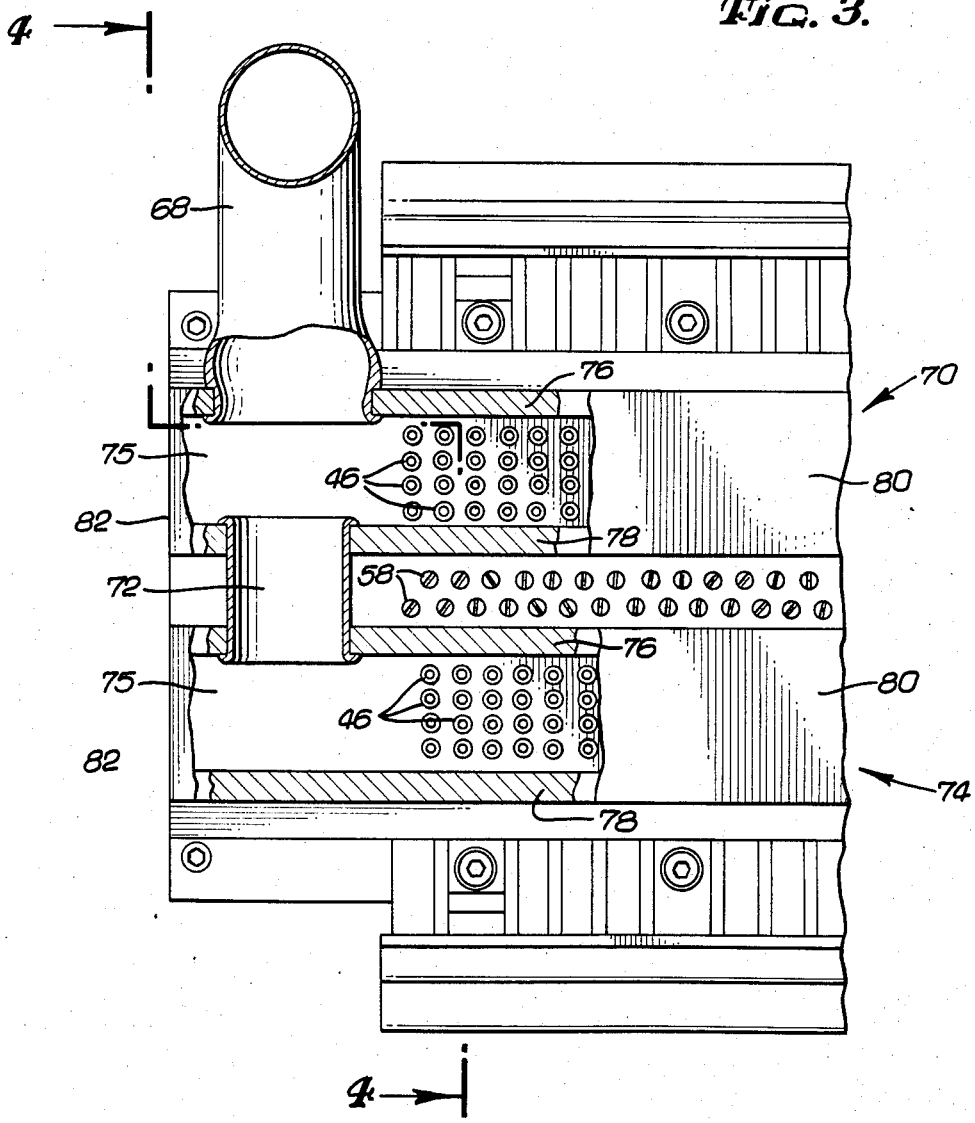
FIG. 3 is a rear view along the line 3—3 of FIG. 2 with a portion broken away of the cooling apparatus of FIG. 1.

In order to cool the hammer bank assembly 10 and maintain the temperature differentials of the hammers 20 and magnets 22 within predetermined ranges, the cooling apparatus 40 directs a flow of air from the fan 42 through the air outlets 46 in the rear frame 12 onto each of the print hammers 20 and magnets 22. The duct structure 44 for directing the air from the fan to the hammer bank assembly 10 includes a conduit 68 connecting the fan 42 to an upper manifold 70 at the back of the rear frame 12. The upper manifold 70 is carried behind the upper row 18 of hammers and magnets as shown in FIGS. 1, 3 and 4. A tubing 72 connects the upper manifold 70 to a lower manifold 74 which is carried on the rear frame 12 behind the lower row 24 of hammers and magnets.

The manifolds 70 and 74 are generally rectangular in shape and extend the width of the hammer bank assembly 10. Each manifold includes a main wall 75 of the rear frame 12 and upper and lower walls 76 and 78 extending from the main wall 75. The manifolds 70 and 74 each further have a rear wall 80 and end walls 82 forming an airtight enclosure with the walls 75, 76 and 78 of the rear frame 12. The manifolds 70 and 74 also have an additional conduit 68 (FIG. 2) and tubing 72 (not shown) connecting the other end of the manifolds to the fan 42. It is recognized however, that the additional conduit may instead be connected to a separate fan, for example. The fan 42 in the illustrated embodiment is a centrifugal blower capable of providing a flow of air at the rate of 50 cubic feet per minute. Of course, other fans may be utilized to provide a flow of air.

Figure 5:
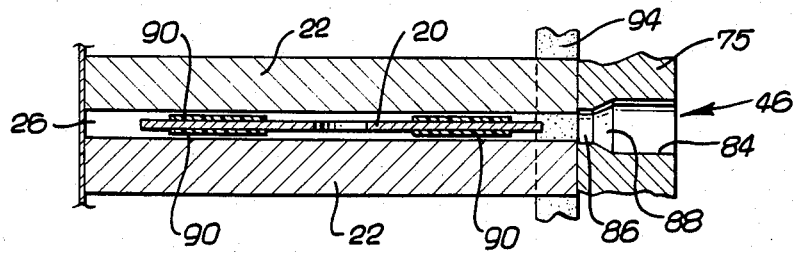
FIG. 5 is a cross-sectional view along the line 5—5 of FIG. 4.

As best seen in FIG. 3, the outlets 46 are drilled into the manifold wall 75 of the rear frame 12 in two upper and lower rectangular matrices. The two matrices of outlets 46 are positioned relative to the upper and lower rows 18 and 24 of the hammers and magnets such that a vertical column of four outlets 46 opens into each gap 26 of the hammer bank assembly 10 (FIGS. 4 and 5). Each column of four air outlets is linearly aligned in registration with the associated hammer.

Each outlet 46 in the illustrated embodiment includes a cylindrical conduit 84 (FIG. 5) connected to a smaller cylindrical conduit 86 by frusto-conical portion 88. The frusto-conical portion 88 and smaller conduit 86 form a nozzle for the larger conduit 84 constricting the flow of air to increase the flow rate. The conduit 86 of the outlet 46 connects directly with the gap 26 with the magnets 22 flanking the gap 26 slightly covering the opening of the passage 86. This further constricts the flow of air to further accelerate the air flow.

As shown in FIG. 5, the flow of air from the outlets 46 passes over the surfaces of the magnets 22 forming the gap 26 and also passes over either side of the hammer 20 positioned in the center of the gap 26. Each hammer 20 has circular dry lubricating tabs or dots 90 affixed to the hammer 20 (which may be woven glass tape impregnated teflon TM ) to reduce friction between the hammer 20 and the adjacent magnets 22. The dots 90 cover a limited area to insure that air passages 92 are maintained on both sides of the hammer 20 to facilitate the cooling of the hammers 20 and magnets 22.

Referring now to FIG. 4, the illustrated embodiment further has foam rubber sealing strips 94 above and below the magnets 22 forming a seal between the rear frame 12 and the magnets 22 of the hammer bank assembly 10 to insure that the air exiting from the outlets 46 is directed between the hammers and magnets and does not escape over or below the hammers and magnets.

The manifolds 70 and 74 and the matrices of outlets 46 provide a flow of air into the gaps 26 at a uniform pressure for each of the gaps 26 of the hammer bank assembly 10. It has been found the temperature differential of the coils 50 of the hammers 20 may be maintained within a range of 8° C. with a flow of air at the rate of 50 cubic feet per minute. Furthermore, it has been found that the temperature differential of the magnets may be maintained within a range of 6° C. with these air flow rates and pressures. Thus, the temperature range from the warmest to the coolest magnet does not vary by more than 6° C. during the operation of the printer and the temperatures of the hammers do not vary by more than 8° C.

Since the temperatures of the hammer coils do not vary significantly, the resistances of the various coils will not vary significantly either. Thus, the need for expensive constant current sources to energize the coils is eliminated. Instead, a relatively inexpensive well regulated voltage source will suffice to insure that the magnetic flux produced by the coils 48 and hence the flight times of the hammers will not vary significantly among the various hammers.

It will, of course, be understood that modifications of the present invention, in its various aspects, will be apparent to those skilled in the art, some being apparent only after study and others being merely matters of routine electronic and mechanical design. Other embodiments are also possible, but their specific designs depend upon the particular application. As such, the scope of the invention should not be limited by the particular embodiment herein described but should be defined only by the appended claims and equivalents thereof.

I claim:

1. An apparatus for minimizing temperature changes of a plurality of interleaved print hammers and magnets in an impact printer hammer bank assembly, wherein the magnets are supported by a frame member, and each pair of adjacent magnets defines a gap therebetween, and wherein each print hammer has an electromagnetic coil which is disposed within a gap, said apparatus comprising:

a fan for producing a flow of air; and duct means for directing the flow of air from the fan into each gap between adjacent magnets, the duct means including a plurality of conduits passing through the frame member and having outlets located in the frame member, each conduit having a nozzle for accelerating the flow of air, and said outlets being positioned adjacent the plurality of hammers and magnets and aligned with respect to the hammers and magnets so that accelerated air exiting from each outlet passes directly into a gap and past the hammer coil and magnets of the gap to dissipate excess heat generated by the coils to thereby minimize temperature increases in the hammers and magnets caused by the operation of the hammer bank assembly.

2. The apparatus of claim 1 wherein the duct means further comprises a manifold mounted on rear of the frame member over the conduits, for receiving air from the fan and directing air to the conduits.

3. The apparatus of claim 1 wherein each outlet is aligned with a hammer such that the flow of air exiting a frame member outlet is directed toward a particular hammer and the magnets adjacent that hammer.

4. The apparatus of claim 1 further comprising first and second sealing strips, located adjacent the frame member at the top and bottom of the magnets, respectively, for minimizing the escape of air between the frame member and the magnets before the air passes through the gaps between the magnets.

5. The apparatus of claim 4 wherein the sealing strips abut the hammers when the hammers are in a rest position.

6. An impact printer hammer bank assembly, comprising:

a plurality of print hammers each having a planar body having a coil therein;

a plurality of magnets;

a frame member for supporting the hammers and magnets aligned in at least one row on the frame member with each adjacent pair of magnets defining a gap, wherein said hammers and magnets are interleaved and a hammer is disposed within each gap, said frame member having a plurality of air conduits, each conduit having a plurality of outlets associated with each hammer within a gap, said outlets being adjacent the hammers and magnets and linearly aligned in registration with the associated hammer;

a fan for producing a flow of air; and a manifold carried on the frame member coupled to the conduits and having an inlet operably connected to the fan, said manifold for directing air from the fan to the frame member outlets such that air exiting from each plurality of outlets associated with a particular hammer exits directly into the gap and around either side of the hammer body to dissipate excess heat generated by the hammer coils to thereby minimize temperature increases in the hammer and magnets caused by the operation of the hammer bank assembly.

7. The apparatus of claim 6 wherein each outlet has a nozzle for accelerating the flow of air exiting the outlet.

8. The apparatus of claim 7 wherein the magnets on either side of a particular hammer partially block the outlets associated with that hammer such that the flow of air is further accelerated.

9. The apparatus of claim 8 further comprising lubricating tabs located between adjacent hammers and magnets to reduce friction therebetween and to insure a space between adjacent hammers and magnets to facilitate the flow of air between the hammers and magnets.

10. An apparatus for limiting the temperature differential of a plurality of hammers and magnets in an impact printer hammer bank assembly wherein each hammer has a coil disposed therein, said apparatus comprising:

a frame member for supporting the hammers and magnets aligned in an upper row and in a lower row on the frame member, each adjacent pair of magnets defining a gap and the hammers and magnets being interleaved with a hammer disposed within each gap, said frame member having a plurality of air conduits having outlets arranged in an upper rectangular matrix facing the upper row of hammers and magnets and a lower rectangular matrix facing the lower row of hammers and magnets, with a vertical column of outlets of each matrix being being adjacent to and aligned with a gap between adjacent magnets;

a fan for producing a flow of air;

an upper manifold carried on the frame member for directing air to the upper matrix of outlets and having an inlet operably connected to the fan and a lower manifold carried on the frame member for directing air to the lower matrix of outlets and having an inlet operably connected to the upper manifold, said manifolds for directing air from the fan through the conduits to the conduit outlets so that air exiting from each vertical column of outlets passes directly over the hammer within the associated gap and directly over the magnets flanking the gap to dissipate excess heat generated by the hammer coils and to maintain the temperature differential of the hammer within the gap and the magnets defining the gap within a predetermined range.

11. A hammer bank assembly for use in an impact printer, comprising:

a frame;

a plurality of magnets secured to the frame in a spaced linear array, wherein each pair of adjacent magnets has a gap therebetween;

a plurality of print hammers, each having a generally planar body having a coil therein, wherein the print hammers the magnets so that a hammer body is located within each gap; and cooling means for directing a stream of fluid directly into each of the gaps onto a hammer body in each gap, said cooling means including a plurality of conduits passing through the frame and terminating in an outlet adjacent to and aligned with the hammers and the gaps between the magnets, wherein there is at least one outlet corresponding to each hammer and gap, said cooling means further including a blower for providing air flow and a manifold for coupling air from the blower to the conduits to thereby minimize temperature increases in the hammers and magnets caused by operation of the hammer bank assembly.

12. The hammer bank assembly of claim 11 wherein the magnets are ceramic magnets.

* * * * *